US005511882A

United States Patent [19]

Anwunah et al.

[11] Patent Number: 5,511,882

[45] Date of Patent: Apr. 30, 1996

[54] BATH ROOM SOAP RECYCLING DEVICE

[76] Inventors: Vincent Anwunah; John Anwunah, both of 12015 Prest, Detroit, Mich. 48227

[21] Appl. No.: 398,357

[22] Filed: Mar. 3, 1995

[51] Int. Cl.[6] ..... B01F 7/16

[52] U.S. Cl. ..... 366/314; 222/333

[58] Field of Search ..... 366/168.1, 172.1, 366/173.1, 173.2, 181.6, 181.8, 182.2–182.4, 190, 191, 205, 206, 314; 222/333, 383.1

[56] References Cited

U.S. PATENT DOCUMENTS

| | | | |
|---|---|---|---|
| 2,740,029 | 3/1956 | Kueser et al. | 366/205 X |
| 3,214,143 | 10/1965 | Jamison | 366/182.2 |
| 3,337,192 | 8/1967 | Efstathiou | 366/181.8 |
| 3,493,215 | 2/1970 | Edwards et al. | 366/205 X |
| 3,548,280 | 12/1970 | Cockroft | 366/205 X |
| 4,229,634 | 10/1980 | Hickman . | |
| 4,297,038 | 10/1981 | Falkenbach . | |
| 4,578,246 | 3/1986 | Pope . | |
| 4,708,487 | 11/1987 | Marshall . | |
| 4,767,217 | 8/1988 | Van den Brink et al. . | |
| 5,112,135 | 5/1992 | Rupp . | |
| 5,238,302 | 8/1993 | Rohan . | |
| 5,273,358 | 12/1993 | Byrne et al. | 366/205 |
| 5,286,106 | 2/1994 | Burgos | 222/235 X |
| 5,368,387 | 11/1994 | Creighton et al. | 366/191 X |
| 5,380,086 | 1/1995 | Dickson | 366/205 X |

*Primary Examiner*—Charles E. Cooley
*Attorney, Agent, or Firm*—Charles W. Chandler

[57] ABSTRACT

A bath room soap recycling device includes a mixing container, a water container, a liquid soap container, and a motor housing. The containers are built in one unit, with separating walls and controlled openings for a water inlet and a liquid soap outlet. The mixing container is provided with a rotary blade mixer mounted on a rotatable vertical driven shaft that extends through a sealed bearing assembly; the lower end of the shaft is directly connected to a motor mounted within a motor housing below the mixing container. Liquid soap is produced through recycling of left-over pieces of bath room soaps by the simple process of adding water and mixing to a desired thickness or consistency. Water for the mixing process is supplied by a motor-driven pump operatively located between the water container and the mixing container. The liquid soap container stores the mixed soap solution separately from the mixing container.

1 Claim, 2 Drawing Sheets

BATH ROOM SOAP RECYCLING DEVICE

BACKGROUND OF THE INVENTION

This invention involves the recycling of left-over pieces of bath room soaps into liquid soap for further use as hand washing or shower soap; the liquid soap can also be used for car washing, with the addition of a waxing compound.

In this age of environmental awareness and subsequently, advocacy for conservation and protection as a means of saving the environment and the ozone layer, recycling has been the center of the campaign. Government encourages recycling in all aspects of human endeavor as a means of reducing waste and conservation of resources. Oil, metal, paper and chemicals are now being recycled for further use and, yet the soap we use in our homes for showers has not in any form been recycled; hence this invention.

The recycling device of this invention effectively recycles left-over pieces of bath room soaps into liquid soap by a simple mixing process, which converts the pieces of soaps from solid/semi solid form to liquid form. An average family of two uses one bath room bar of soap a week, and one fifth of the soap is thrown away due to breaks and/or reduction in size. This means that in a year an average family of two will buy fifty two bath room bar soaps, and 10.4 bars will be wasted. This invention aims at eliminating that waste and save each family some money through recycling that is easy, simple and cheap.

SUMMARY OF THE INVENTION

It is an object of the present invention to provide a soap recycling device with mixing container, water container, liquid soap container, water pump, and motor in one operating unit.

It is a further object of the invention to provide a recycling device with a mixing container having a top opening with attached cover, separating walls, and two openings for water inlet and liquid soap outlet, equipped with push button controls.

It is a further object of the invention to provide a recycling device with a water container, a soap-water mixing container, and a pump for pumping water from the water container into the mixing container, said pump being supplied with water under push button control, whereby the quantity of water in the mixing container is readily controlled.

It is an additional object of the invention to provide a recycling device with a liquid soap storage container and a built-in conventional liquid soap dispenser and controlled liquid inlet button to allow recycled soap to flow into the soap storage container by gravity from the mixing container.

The soap recycling device of the invention can be compact and small sized. It can also be produced in any size and can be used for production of home-made body lotion so as to be suitable for placement on a bath room sink counter, or in any convenient location in a house.

The soap recycling device includes a mixing container with a top access opening and a cover that swings upwardly when open. The bottom wall of the mixing container in the recycling device has an opening that accommodates a vertical rotatable shaft and bearing arrangement that is similar to shaft-bearing arrangements commonly used in electric blenders. The lower portion of the vertical shaft is operatively connected to a vertical axis electric motor supported in a motor compartment, or chamber, located below the mixing container (or chamber).

The electric motor is connected with a thermal overloading switch for deactivating said motor when overheated, switching means for selectively activating said motor, and electrical plug means for plugging the motor into a power source. When the switching means is activated, the output shaft of the electric motor will rotate the aforementioned vertical shaft at high speed, causing the mixing blades and an associated water pumping apparatus to rotate; the pumping apparatus delivers water from the water container to the mixing container. Once the solid/semi-solid pieces of soaps have been mixed to a desired liquid form, a liquid outlet button is released to allow the liquid soap to flow from the mixing container into the liquid soap container from where it can be dispensed via a commonly used liquid dispenser.

These and other objects and advantages of the invention will become evident from the following detailed description of the presently preferred embodiments thereof, with references to the appended drawings in which:

DESCRIPTION OF THE PREFERRED EMBODIMENT

It is preferred that the motor used for mixing soap and water be controlled by a plurality of push buttons connected to the motor circuit, to provide on-off button control, as well as to vary the rotational speed of the motor and the mixing shaft driven by the motor.

It is further preferred that ventilation be provided in the rear wall of the motor housing, and that sufficient space be provided in the motor housing to maintain a desired air circulation within the motor housing. The motor drive shaft is permanently coupled to the mixing shaft that extends upwardly through the bottom wall of the mixing container.

Figure 1:
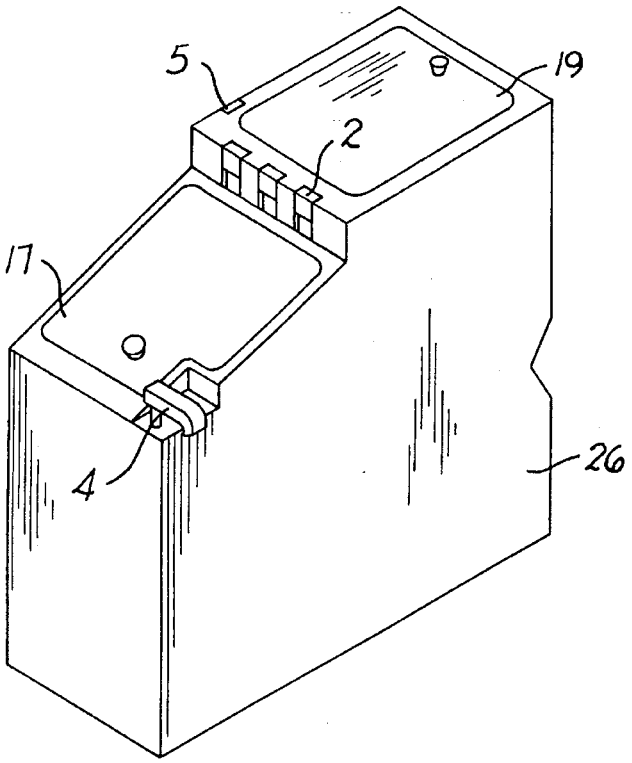
FIG. 1 is a perspective view of a soap recycling device of the invention.

Referring now in more detail to the drawing, in which like numerals refer to like parts throughout the several views, FIG. 1 illustrates a device for bath soap recycling in accordance with the present invention. The device comprises a housing 26, mixing chamber cover 19, liquid soap release button 5, water chamber cover 17, liquid soap dispensing knob 4, and three water flow control push buttons 2.

Figure 2:
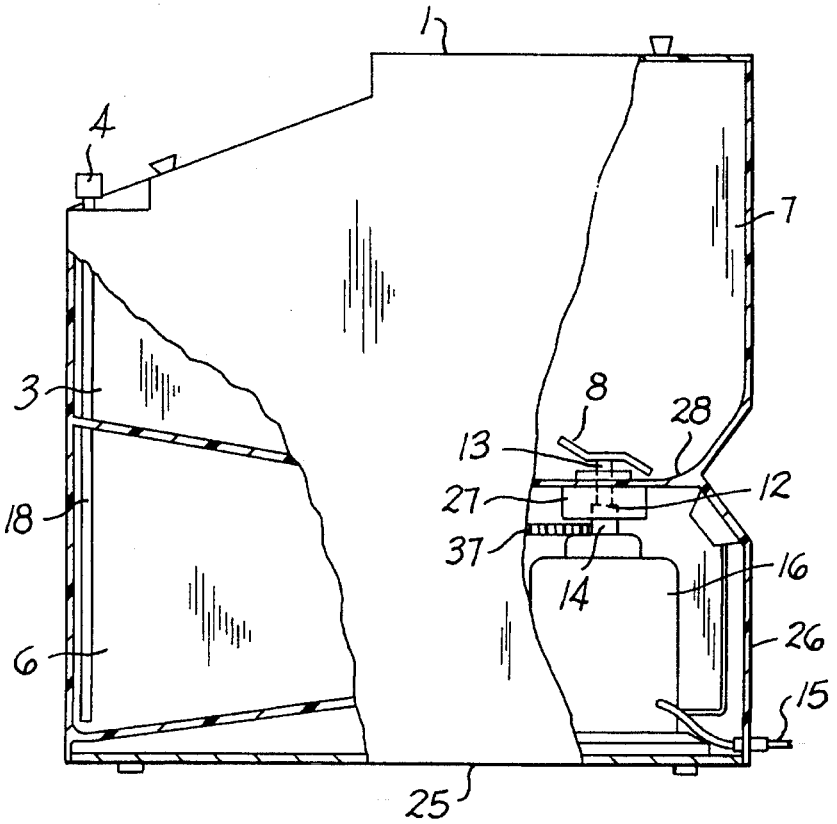
FIG. 2 is a right elevational view of a soap recycling device of FIG. 1, with portions broken away to show internal details.
Figure 3:
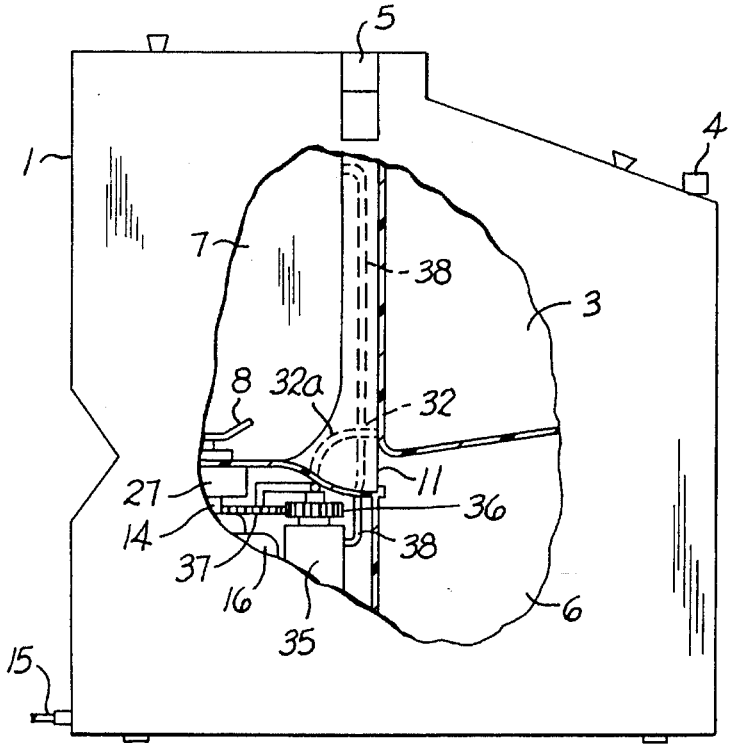
FIG. 3 is a left elevational view of the soap recycling device of FIG. 1, with portions broken away to show details of internal structure.

Referring now to FIG. 2, a portion of the outer covering of mixing chamber 7, housing 26, water chamber 3 and liquid soap chamber 6, have been broken away to reveal internal structural details. The base 25 supports housing 26 in an upright position; e.g. on a bath room counter. As shown, the housing provides the mixing chamber 7, water chamber 3, and liquid soap chamber 6, in one unit. The mixing chamber 7 has a bottom wall 28 spaced above base 5; the space directly below chamber 7 forms a compartment or chamber for an electric motor 16 and a small water pump 35 (FIG. 3).

Motor 16 has a vertical axis drive shaft 14 that is operatively connected to a rotary shaft 12 mounted in a suitable bearing 27. Shaft 12 has an upper end portion 13 that is attached to a blade assembly 8. Thus, when motor 16 is electrically energized the blade assembly 8 rotates to mix water and soap particles previously supplied to chamber 7. The soap particles are initially deposited into chamber 7 through a top access opening normally closed by cover 19. Water is supplied to chamber 7 by the water pump 35.

Motor drive shaft 14 serves as a pinion gear for driving a gear 37 that is in mesh with a pumping gear 36 on pump 35. Thus, electrical energization of motor 16 causes shaft (gear) 14 to drive gears 37 and 36, whereby the water pump is driven by motor 16.

Water is supplied to pump 35 from water chamber 3. The connection between chamber 3 and pump 35 can comprise a transverse drain tube 32 (FIG. 4) located near the lower corner of chamber 3, and a connector tube 32*a* extending downwardly from transverse tube 32 to the pump.

Figure 4:
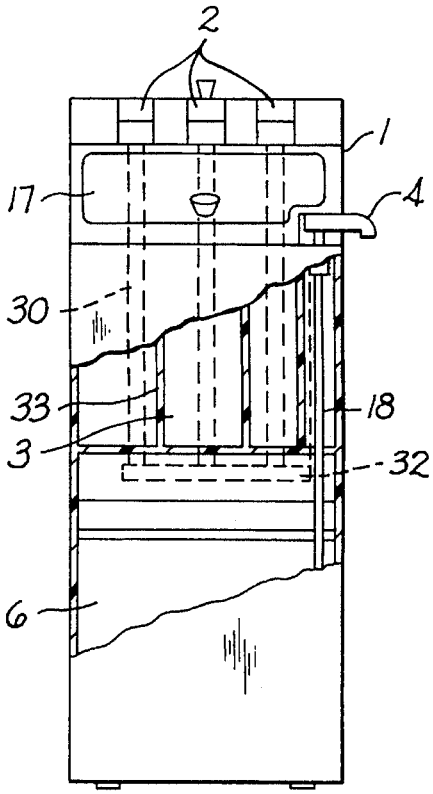
FIG. 4 is a front elevational view of the soap recycling device of FIG. 1, with portions broken away to show details of internal structure.

Water chamber 3 is subdivided into three unequal water storage areas by means of vertical partitions 33 (FIG. 4). Each water storage area has a flow connection with transverse drain tube 32. Water flow from each water storage area into tube 32 is controlled by a water release button (pushbutton) 2. As shown in FIG. 4, each pushbutton 2 has a push rod 30 extending downwardly into transverse tube 32.

A valve element can be provided on the lower end of each push rod, such that when the respective button 2 is pushed downwardly the valve element is opened to allow water to flow from the respective water storage area into tube 32. The water flows through tube 32 into connector tube 32*a*, and then into water pump 35. When the respective button 2 is released the associated push rod 30 returns to its initial position, in which tube 32 no longer receives water from chamber 3. As long as the push button 2 is depressed, water is allowed to flow from chamber 3 to the pump 35, via drain tube 32 and connector tube 32*a*. When the push button is released the flow of water ceases.

Water is initially admitted to chamber 3 by pouring water through the top access opening normally closed by cover 17. The water is subdivided into three separate water quantities by the vertical partitions 33. Water flow out of each water storage area into drain tube 32 is controlled by a separate pushbutton 2.

Pump 35 delivers a pressurized stream of water to tube 38 that extends upwardly to a connection with mixing chamber 7. As long as the pump is supplied with water (by depressing one of the buttons 2) the pump will be enabled to pump water into chamber 7 for mixture and agitation with soap particles. Pumping water into chamber 7 requires depression of a button 2 and the energization of motor 16 (via buttons 20 and 22).

Referring now to FIG. 3, a portion of the outer covering of the recycling device 1 is broken away, showing pans of the structural details of mixing chamber 7, water chamber 3 and liquid soap storage chamber 6. The exposed structure shows an opening 11 in a wall at the upper corner of liquid soap storage chamber 11.

A manually-operated pushbutton 5 is provided on the upper surface of the housing 26 for controlling liquid flow from mixing chamber 7 into liquid soap storage chamber 6. Button 5 is pushed (actuated) to allow liquid soap solution to flow from mixing chamber 7 through opening 11 into storage chamber 6.

Various types of valves can be connected to pushbutton 5 for closing or opening the flow opening 11 at the upper end of chamber 6. For example, a push rod (similar to push rods 30) can be extended downwardly from button 5 to a valve element spanning the flow opening 11. It will be understood that pushbutton 5 is to be actuated only when it is desired to gravitationally discharge soap solution from chamber 7 to storage chamber 6. When pushbutton 5 is in its raised (inactive) position the connection between chamber 7 and storage chamber 6 is closed, such that water can be pumped from chamber 3 into chamber 7 (by pump 35) without escaping from chamber 7.

Figure 5:
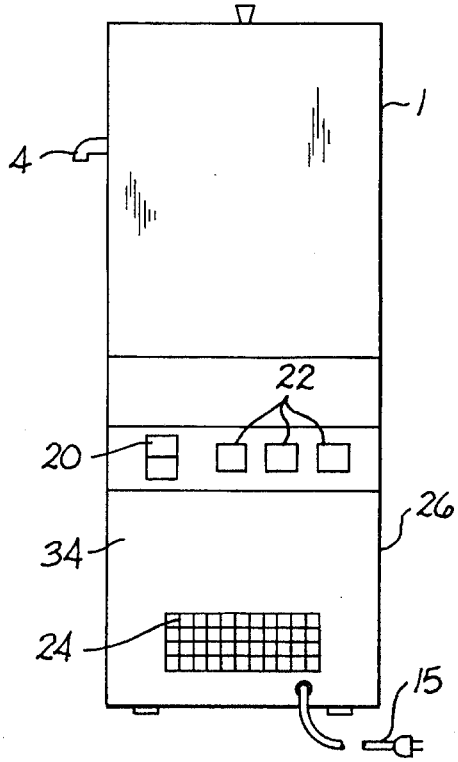
FIG. 5 is a rear elevational view of the FIG. 1 soap recycling device of the invention.

Referring now to FIG. 5, the soap recycling device 1 of the invention has a ventilation grill 24 in back wall 34 for air circulation into the motor housing. Housing 26 also includes a plurality of pushbuttons for controlling the motor speed. As shown, there is an on/off power switch button 20 and three speed control buttons 22. The speed control buttons 22 can only function when power switch button 20 is turned on; when the respective speed button is pushed, the motor spins, spinning the blades 8 to mix the contents in the mixing chamber 7. Motor 16 is supplied with electrical power via an electrical cord 15 adapted to be plugged into any available electric outlet.

Referring to FIGS. 2 and 4, there is shown a conventional mechanism for dispensing soap solution out of soap solution storage chamber 6. The mechanism comprises a vertical dispensing tube 18 connected to a knob 4. The lower end of tube 18 is located within chamber 6.

The process of dispensing soap solution from chamber 6 involves momentary manual depression of knob 4. As the know returns to its initial position a suction condition is established in tube 18. Soap solution is thereby drawn upwardly through the tube and out through the hollow knob 4.

By way of review, the illustrated soap recycling device 1 comprises a water chamber 3, soap-water mixing chamber 7, liquid soap storage chamber 6, and a motor chamber located directly below mixing chamber 7. The motor 16 in the motor chamber drives the water from chamber 3 into mixing chamber 7 (when motor 16 is energized and one of the buttons 2 is depressed).

The water pumping operation is initiated by depressing one of the buttons 2 while motor 16 is in an energized condition. Water flows from pump 35 into tube 38, and then into chamber 7. When the respective button 2 is released the water pumping operation ceases because pump 35 is then deprived of a water supply; the pump will continue to run as long as motor 16 is electrically energized (but without pumping any water).

Button 2 will be depressed until a desired quantity of water is pumped into chamber 7. The water quantity will be visually determined according to the quantity of soap particles charged into chamber 7 through the access opening normally closed by cover 19. Motor 16 will be energized (by buttons 20 and 22) until blades 8 cause the soap particles to be fragmented, mixed and dissolved in the water in chamber 7.

Push button 5 is actuated after the soap solution is formed in chamber 7. With motor 16 de-energized, button 5 can be depressed to allow soap solution to flow gravitationally from chamber 7 into storage chamber 6, via flow opening 11. When button 5 is released the flow of soap solution into storage chamber 6 ceases.

Soap solution can be dispensed out of chamber 6 at anytime, by depressing hollow knob 4.

While this invention has been described with reference to the specific embodiments disclosed herein, it is not confined to the details set forth; the patent is intended to include modifications and changes which may come within and extend from the following claims.

Having described our invention, we claim:

1. A soap particle recycling device comprising:

a housing (26) having internal partitions therein forming a water chamber (3), a mixing chamber (7), a liquid soap storage chamber (6), and a motor chamber;

said partitions being constructed so that the motor chamber is directly below the mixing chamber, and the liquid soap storage chamber is directly below the water chamber;

a rotary blade means (8) in said mixing chamber for agitating water and soap particles to form a soap solution in the mixing chamber;

an electric motor (16) in said motor chamber, shaft means (12) driven by said motor and connected to said blade means, whereby the blade means is powered by said motor;

a water pump (35) in said motor chamber; first water passage means (32) gravitationally connecting said water chamber to said pump; a first manual control means (2) controlling flow through said first water passage means;

a second water passage means (38) connecting said pump to said mixing chamber so that when the pump is supplied with water from said first water passage means, the pump delivers a pressurized stream of water through said second water passage means to said mixing chamber;

drive means (37, 36) mechanically connecting said motor to said pump whereby the pump is powered by the motor;

a soap solution passage gravitationally connecting said mixing chamber to said liquid soap storage chamber; and a second manual control means (5) controlling flow through said soap solution passage, whereby soap solution is enabled to flow gravitationally from said mixing chamber to said liquid soap storage chamber when said second manual control means is actuated.

* * * * *